United States Patent [19]

Tucker

[11] Patent Number: 4,826,149

[45] Date of Patent: May 2, 1989

[54] MECHANICAL DOUBLE CALIPER

[75] Inventor: Daniel A. Tucker, Plattsburgh, N.Y.

[73] Assignee: AM International Incorporated, Chicago, Ill.

[21] Appl. No.: 54,295

[22] Filed: May 26, 1987

[51] Int. Cl.[4] ..... B65H 7/12

[52] U.S. Cl. ..... 271/263

[58] Field of Search ..... 271/262, 263

[56] References Cited

U.S. PATENT DOCUMENTS

| | | | |
|---|---|---|---|
| 2,670,954 | 3/1954 | Bach | 271/263 |
| 3,875,860 | 4/1975 | Barber | 271/263 X |
| 4,021,030 | 5/1977 | Fichte | 271/263 X |
| 4,132,402 | 1/1979 | Morrison | 271/263 |
| 4,378,109 | 3/1983 | Takahashi | 271/263 |
| 4,527,793 | 7/1985 | Bottcher | 271/263 |

*Primary Examiner*—Richard A. Schacher

*Attorney, Agent, or Firm*—Tarolli, Sundheim & Covell

[57] ABSTRACT

Apparatus for sensing a double thickness of a sheet-like product being conveyed past the apparatus by a feed device comprises a roll positionable adjacent the feed device. The roll has a perimeter partially defining a gap in the path of movement of the product. A support structure supports the roll for rotation relative thereto and for movement away from the path. A sensor senses movement of said roll away from said path. A caliper member is supported adjacent to the support structure. The support structure is mounted for adjustment to a position in which the gap has a width which is greater than the thickness of the product and less than the thickness of two products in response to positioning the product between the support structure and the caliper member. An adjustable member is movable to hold the support structure in the position to which it is move in response to positioning of the product between the support structure and the caliper member.

10 Claims, 5 Drawing Sheets

MECHANICAL DOUBLE CALIPER

BACKGROUND AND SUMMARY OF THE INVENTION

The present invention relates to sensing the misfeeding of sheet-like articles, and in particular relates to a caliper for use in a collator for sensing the feeding of multiple signatures to a collating conveyor.

A caliper is used in signature collators. The caliper includes a sensing roll which is positioned adjacent to a signature feeding drum. The drum has grippers which feed signatures past the sensing roll. The sensing roll is positioned relative to the drum so as to move in response to a multiple thickness of material (two or more signatures) conveyed by the drum, but which will not move if a single thickness of material (one signature) is conveyed by the drum. If a double thickness of material is fed, the collated assembly of signatures becomes defective and typically will be rejected in response to the sensing by the caliper.

Depending upon the thickness of the signature being conveyed, the position of the sensing roll must be adjusted. The mechanism for adjusting the position of the sensing roll for known calipers is complicated and cumbersome to operate. This results in substantial time being required for adjustment of the caliper. Also, the known calipers cannot be adjusted for extremely thin products because the many parts of the caliper system which need to be adjusted make fine adjustment impossible.

The present invention is directed to a caliper apparatus constructed so that the time for making the caliper adjustment is on the order of a few seconds as opposed to minutes as required by the prior calipers, and also the thickness of the material which can be handled by the caliper is substantially thinner than the thinnest material which can be handled by previous calipers.

The caliper of the present invention includes a roll which has a perimeter partially defining a gap in the path of movement of the signatures. The roll is supported for rotation relative to a support, and the roll is also supported by the support for movement away from the path of the movement of the signatures. A suitable means senses the movement of the roll away from the path of movement of the signatures.

The support for the roll is mounted for adjustment to a position in which the gap defined by the perimeter of the sensing roll has a thickness greater than the thickness of the signatures being conveyed through the gap and less than the thickness of two signatures. The adjustment of the support, and thus of the roll, is effected in response to positioning a signature between the support and a caliper member mounted adjacent to the support. An adjustable member is provided which holds the support in the position to which it is moved in response to positioning of the signature between the support and the caliper member. Thus, by merely positioning a signature between the caliper member and the support the sensing roll becomes located in the desired position to sense double feeding of signatures. This adjustment can be made in a matter of seconds.

The support for the sensing roll comprises a linkage which includes a pair of arms which extend annularly relative to each other. The sensing roll is supported on one end of one arm for rotation relative to the arm and also for pivotal movement relative to the arm. The sensing roll pivots relative to the arm in response to a double signature being conveyed through the gap partially defined by the sensing roll. The pivoting movement of the sensing roll effects actuation of a suitable sensor.

The aforementioned caliper member is adjacent to the other arm of the linkage. When a signature is positioned between the caliper member and the other arm of the linkage, the linkage pivots and the sensing roll becomes located in a position such that the gap through which the signatures move is of a thickness greater than that of one signature but less than that of two signatures. This occurs automatically because of the relative distances from the point at which the linkage pivots to the sensing roll and to the caliper member.

DESCRIPTION OF THE DRAWINGS

Further features of the invention will become apparent to those skilled in the art to which the present invention relates from reading the following specification with reference to the accompanying drawings in which.

DESCRIPTION OF A PREFERRED EMBODIMENT

Figure 2:
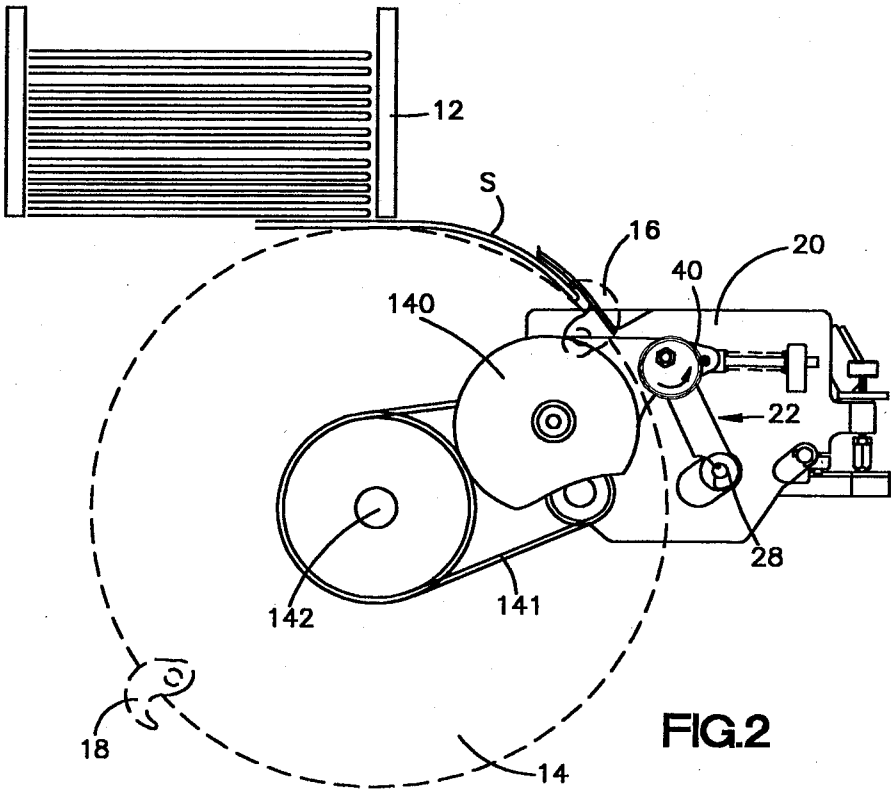
FIG. 2 is a schematic side elevational view illustrating a portion of the collating machine and the caliper apparatus of the present invention.

The present invention is a caliper apparatus for sensing a double thickness of sheet-like material such as a signature which is being conveyed past the apparatus. The apparatus may be used in a variety of different types of environments and machines By way of example, the present invention is illustrated in the drawings and described herein as used in a collator for sensing the feeding of multiple signatures (doubles) by the collating apparatus.

Figure 1:
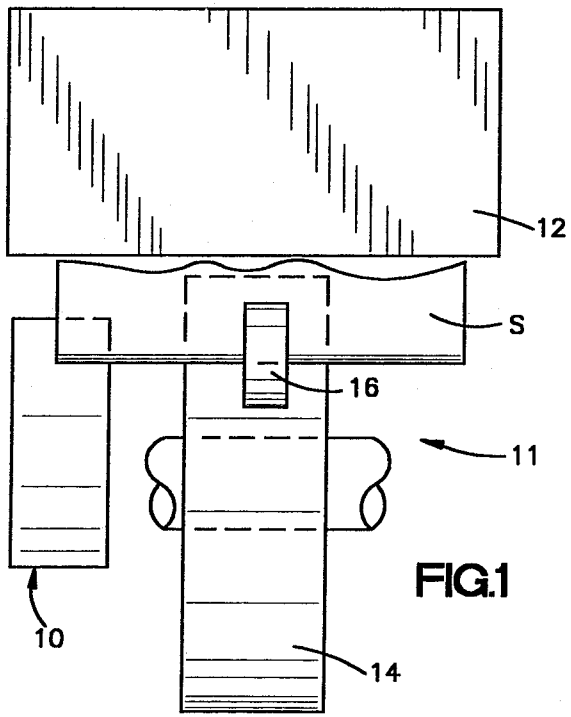
FIG. 1 is a view showing schematically the location of a caliper apparatus of the present invention in a collating machine.

FIG. 1 schematically shows a caliper apparatus 10, embodying the present invention, mounted at a feeding station 11 in a collating apparatus. At the feeding station 11 is a hopper 12 which contains a supply of signatures S to be fed to the collating conveyor not shown. The signatures contained in the hopper 12 are removed from the hopper 12 and fed to the collating conveyor by a drum 14. The drum 14 carriers a pair of grippers 16, 18 at diametrically opposite locations. The grippers 16, 18 sequentially grip the lower most signature in the hopper 12 and feed the signatures to the collating conveyor of the collating apparatus.

The caliper mechanism 10 is located adjacent to the gripper drum 14 and as the signatures are fed the edge of the signatures encounter the caliper apparatus 10. The caliper apparatus 10 senses whether two or more signatures are being fed and in that event the caliper apparatus 10 sends a signal to a suitable control mechanism so that the collated signature assemblage containing the multiple signatures will be rejected subsequently in the operation of the collating apparatus.

Figure 5:
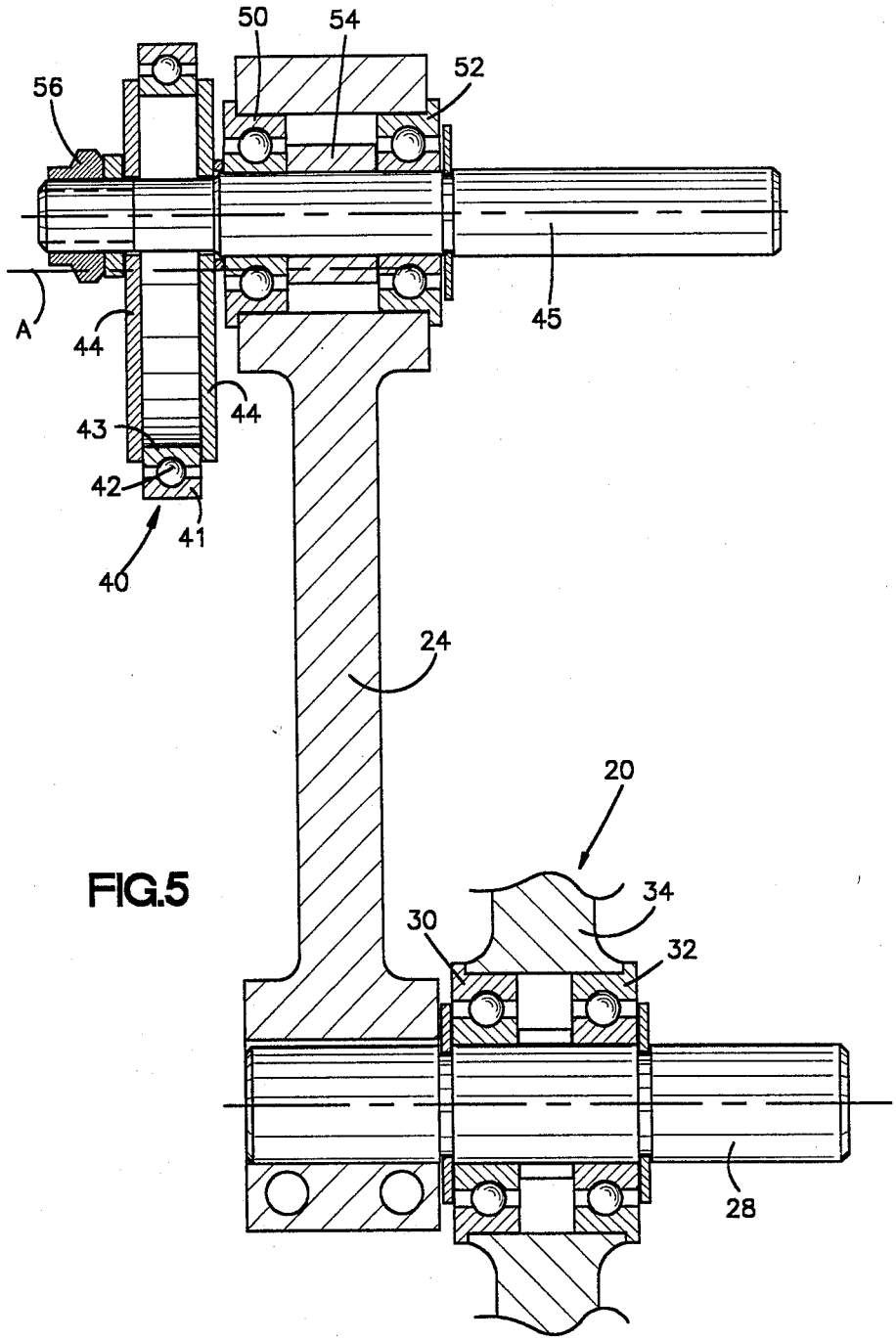
FIG. 5 is a sectional view taken along section line 5—5 of FIG. 3.

The caliper apparatus 10 includes a frame 20 suitably supported in the collating machine. The frame 20 supports a linkage 22 for pivotal movement about an axis 23 relative to the frame 20. The linkage 22 includes a pair of arms 24, 26. The arms 24, 26 are fixed to a shaft 28. The axis 23 is the axis of shaft 28. The shaft 28 which is rotatably supported by a pair of bearings 30, 32 in a portion 34 of the frame 20, (see FIG. 5). The arm 24 is located on one side of the frame 20 and the arm 26 is located on the other side of the frame 20. The arm 24 and the arm 26 extend at an angle relative to each other.

A signature sensing roll 40 is supported at the end of the arm 24. The roll 40 is a ring 41 which is supported on ball bearings 42. The inner race 43 for the ball bearings 42 is connected to a pair of circular discs 44. The discs 44 in turn are fixed to a shaft 45. The shaft 45 is eccentric relative to the discs and to the roll 40. Because of the ball bearings 42 the ring 41 may rotate about its axis A and relative to the shaft 45.

The shaft 45 extends through the arm 24 and is supported by bearings 50, 52 in the arm 24 for rotational movement relative to the arm 24. A spacer 54 extends between the bearings 50, 52. The shaft 45 extends through the discs 44 at a location offset from the axis A of the roll 41. The outer end of the shaft 45 is threaded and a nut 56 is threaded on the shaft to fix the discs 44 on the shaft 45 so that they do not rotate relative to the shaft.

The arm 26 is fixed to shaft 28 and extends generally horizontally away from the shaft 28. A handle 60 is located on the outer end of the arm 26. The handle 60 extends transverse to the extent of the arm 26. By manually applying a downward force to the handle 60, the arm 26 pivots downwardly as viewed in the drawings and the arm 24 pivots clockwise about the axis of the shaft 28, as viewed in FIG. 3 of the drawings.

Figure 3:
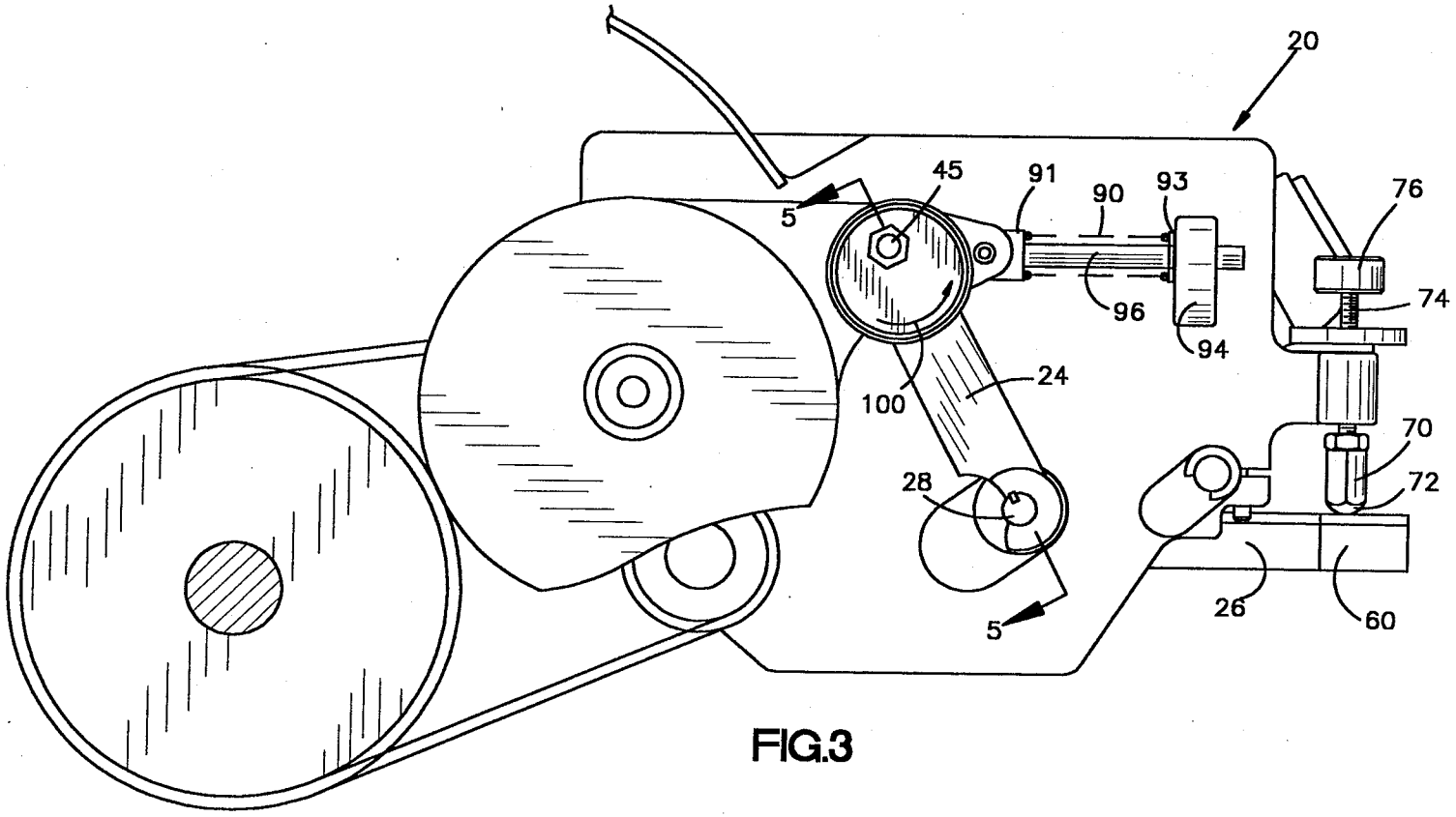
FIG. 3 is a schematic side elevational view on an enlarged scale similar to that of FIG. 2 illustrating the caliper apparatus of the present invention.

An adjustable stop member 70 is associated with the outer end of the arm 26. The adjustable stop member 70 has a spherical end 72 and is attached to a threaded member 74 which is threaded into a portion of the frame 20. Upon rotation of a knob 76 on the end of the member 70, the member 74 moves vertically. Thus, the member 70 can be moved into a position holding the arm 26 in any position to which the arm 26 is moved. For example, if arm 26 is moved downwardly, as shown in FIG. 3, the member 70 can be also be moved downwardly to hold the arm 26 in the position to which it is moved. This also holds the arm 24 and the roller 40 in the position to which they are moved.

Intermediate the member 70 and the shaft 28, a caliper member 80 (FIG. 4) is mounted on the frame 34 adjacent to the arm 26. The caliper member 80 is a rod-like member suitably attached to the frame 34. To adjust the position of the roll 40 relative to the feeding drum 14, all that it is necessary to do is to depress the arm 26 and place a signature, which is to be conveyed, between the caliper member 80 and the adjacent portion of the arm 26. When this is done the roll 40 is moved to a position relative to the drum 14 so as to space the periphery of the roll 40 a distance from the drum 14 which is approximately one and one half (1½) times the thickness of the signature. This occurs automatically because of the relative dimensions of and distances between the various parts of the linkage 22. Specifically, the distance Y (FIG. 6) between the point where the caliper 80 engages the signature to the axis 23 is less than the distance X between the axis 23 and the point where the perimeter of the roll 40 engages the signature which is being conveyed. In fact, the distance X is one and one half (1½) times the distance Y. Therefore the movement of the roll 40 as a result of a signature being located between caliper 80 and arm 26 is increased or multiplied due to the different lengths of X and Y. Thus, by merely positioning a signature which is being conveyed between the caliper 80 and the arm 26 the perimeter of the roll 40 becomes positioned from the drum 14 one and one half (1½) times the thickness of a signature being fed through the gap between the roll 40 and the drum 14.

A suitable spring 90 acts through a collar 91 to bias the arm 24 and roll 40 toward the path of the movement of the signatures. The spring 90 at one end acts against a collar 93 which is threadedly adjustable in a boss 94 of the frame 34. A rod 96 extends through the boss 94 and is attached to the collar 91.

If the roll 40 is positioned in the appropriate position and multiple signatures are conveyed by the drum 14, the roll 40 will be pivoted about the axis of the shaft 45 away from the perimeter of the drum 14. Such as indicated by the arrow 100 in the drawings. This movement of the roll 40 will result in the shaft 45 rotating in a counter-clockwise direction as shown in FIG. 3. The shaft 45 would rotate in a clockwise direction as shown in FIG. 4 and indicated by the arrow 101.

An arm 110 (see FIG. 4) is fixedly supported on the shaft 45 by a clamp screw 112. The arm 110 has a portion **110*a* which extends adjacent to a switch 114. The switch 114 has a switch actuator 116. The arm portion 110*a* is normally positioned against the switch actuator 116 by a spring 120 which maintains the switch 114 in a closed condition. The spring 120 acts against a collar 122 fixed on a rod 124. The rod 124 extends through the spring and through a lug 128 fixed to the frame 20. The rod 124 is attached pivotally at 126 to the arm 110. A suitable self-aligning bearing 129 is located between the rod 124, and the lug 128 to permit the rod 124 to pivot relative to the frame portion 128. The spring 120 acts between the self-aligning bearing and the collar 122 to bias the rod 124 downwardly as shown in FIG. 4**.

Figure 4:
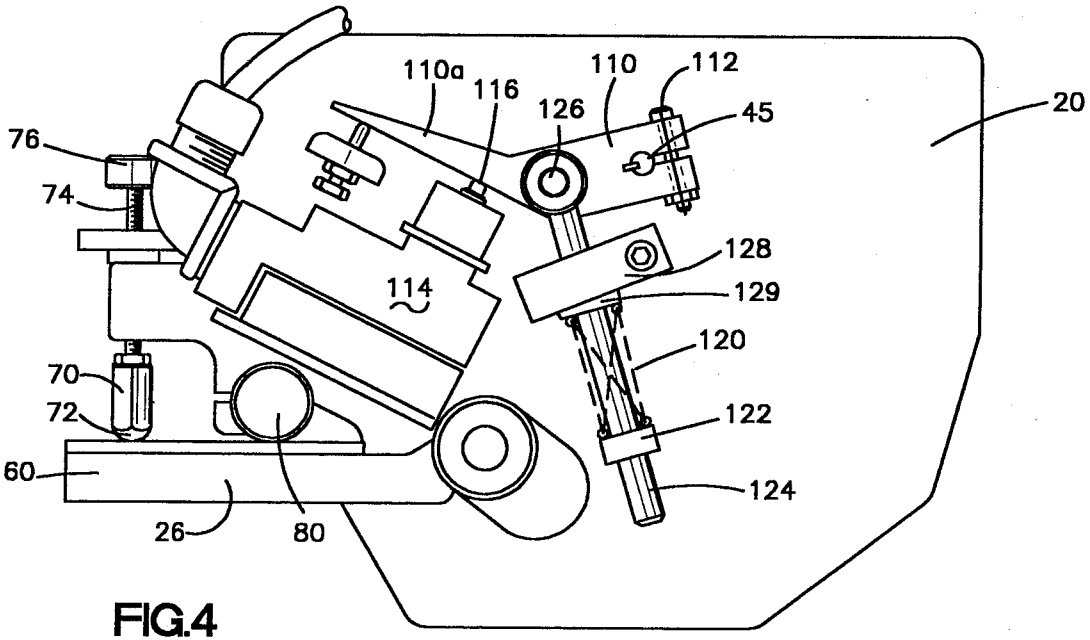
FIG. 4 is a side elevational view of the caliper apparatus of the present invention illustrating the side thereof opposite the side shown in FIG. 3.

When the shaft 45 is rotated in a clockwise direction, as shown by arrow 101 in FIG. 4, the arm 110 is likewise rotated in a clockwise direction with the shaft 45 against the bias of the spring 120. This results in the arm portion **110*a* moving away from the switch actuator 116. The switch 114** therefore is opened causing a signal to be communicated to the collating control unit. This signal is thereafter used by the collating control unit to effect various collating functions downstream from the hopper where the signal was created, including rejecting the signature assemblage which received the double or multiple signatures.

The caliper mechanism 20 includes a back-up disc 140 which engages the signatures being conveyed on a side opposite the side engaged by the sensing roll 40. The back-up disc 140 is suitably driven as by a belt on claim 141, trained about suitable sprockets, from the main drive 142 of the collator.

The back-up disc 140 resists movement of double signatures away from the sensing roll 40 and insures that the sensing roll 40 moves properly when a double is encounted by the roll 40.

The operation and the adjustment of the caliper of the present invention should be apparent from the above.

Figure 6:
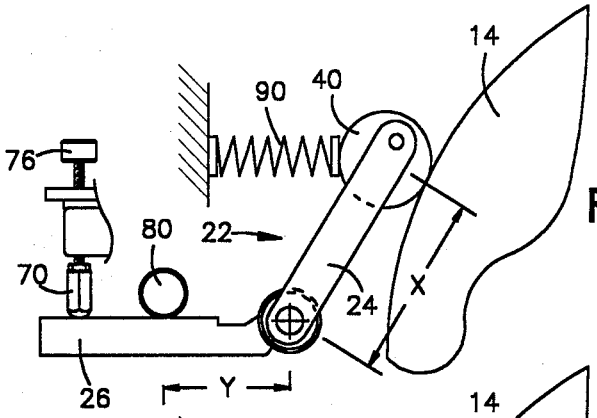
FIGS. 6–9 are schematic illustrations showing various positions of parts of the caliper apparatus to illustrate the operation and the adjustment thereof
Figure 7:
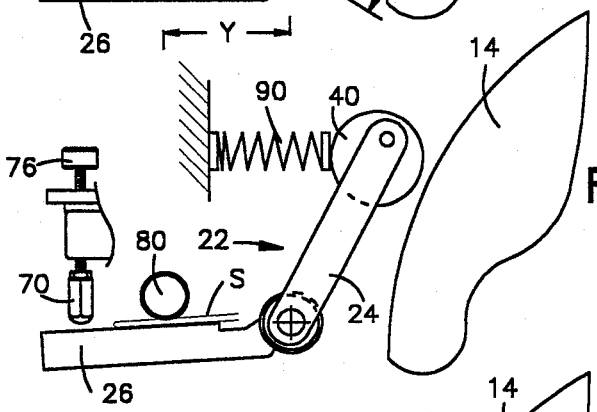
Figure 8:
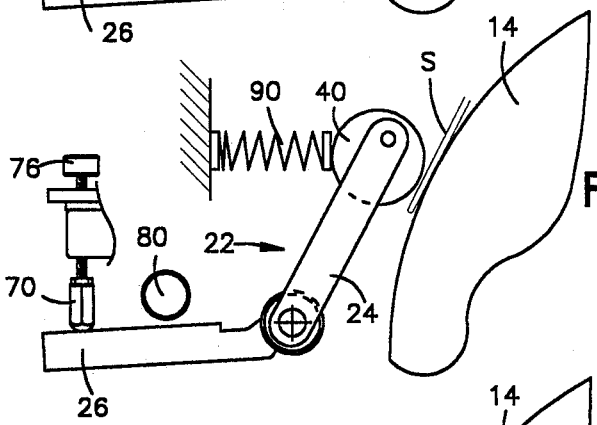

FIGS. 6–9 illustrate the adjustment and operation in a simple manner. FIG. 6 illustrates the apparatus at rest with the spring 90 biasing the roll 40 toward engagement with the drum 14. The adjustable stop 70 is positioned in engagement with the arm 26 and the caliper 80 is also located in position against the arm 26. In order to automatically adjust the perimeter of the roll 40 away from the drum 14, one and one half (1½) times the thickness of a signature, all that is necessary to be done is to position a signature "S" between the caliper 80 and the arm 26, as shown in FIG. 7. Because of the aforementioned multiplication factor do to the relative lengths of X and Y the perimeter of the roll 40 will become located away from the drum 14 and provide a gap through which the signatures move. The thickness of that gap will be approximately equal to one and one half (1½) times the thickness of a signature. After this adjustment occurs, the member 70 is moved into engagement with the arm 26 and holds the arm 26 and arm 24 in the position to which they are adjusted against the bias of spring 90. This is illustrated in FIG. 8, and the signature S may be removed from between the caliper 80 and the arm 26. The apparatus will then function to allow single signatures S to be conveyed through the gap between the perimeter of the roll 40 and the drum 14 as shown in FIG. 8. A small clearance C, (see FIG. 8) will exist between a single signature S which is conveyed and the roll 40.

Figure 9:
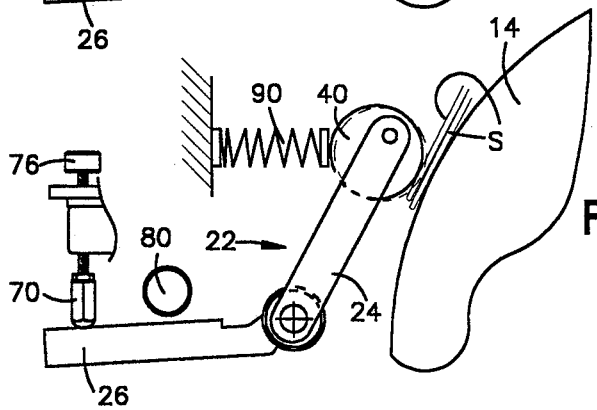

If, however, multiple signatures are conveyed through the gap between the roll 40 and the drum 14, such as a double, the thickness of the double signatures is too great to move through the gap. Therefore, as a double moves through the gap the double will force the roll 40 to pivot about the axis of the shaft 45 in a clockwise direction as illustrated in FIG. 9 by the arrow 100. This pivoting movement of the roll 40 rotates the shaft 45 and causes actuation of the switch 114, as above described.

It should be apparent to those skilled in the art that the present invention provides a simple easily adjusted caliper mechanism for sensing the feeding of multiple signatures. The adjustment of the caliper mechanism can be effected in a manner of seconds and can be adjusted for handling extremely thin signatures.

It should further be apparent to those skilled in the art that certain modifications, changes and adaptations may be made in the present invention and that it is intended to cover all such modifications, changes and adaptations coming within the scope of the appended claims.

I claim:

1. Apparatus for sensing a double thickness of a sheet-like product being conveyed past the apparatus by a feed device, said apparatus comprising:

a roll positionable adjacent the feed device and the path of movement of the product;

support means for supporting said roll for rotation relative thereto and for movement away from said path;

means for sensing movement of said roll away from said path;

a caliper member located adjacent said support means;

means for mounting said support means for movement to a position in which said roll is spaced from said feed device a predetermined distance which is greater than the thickness of the product and less than the thickness of two products in response to positioning the product between said support means and said caliper member; and an adjustable member movable into engagement with said support means to prevent movement of said support means from the position to which it is moved in response to positioning of the product between said support means and said caliper member to a position in which the distance between said roll and said feed device is less than said predetermined distance.

2. An apparatus as defined in claim 1 further including a spring for biasing said support means and said roll toward the feed device.

3. An apparatus as defined in claim 1 wherein said support means comprises a linkage and said mounting means comprises a shaft for supporting said linkage for pivotal movement about a pivot axis, said linkage including a pair of arms extending angularly relative to each other and away from said pivot axis, said support means including means for supporting said roll for pivotal movement relative to one of the arms of said linkage, said caliper member being located adjacent the other arm of said linkage.

4. An apparatus as defined in claim 3 wherein said support means comprises a shaft extending through said one arm and supporting said roll at a location offset from the center of said roll.

5. An apparatus as defined in claim 4 wherein said roll is supported by a pair of discs fixed on said shaft and further including a bearing encircling said discs and supporting said roll for rotation relative to said discs.

6. Apparatus for sensing a double thickness of a sheet-like product being conveyed past the apparatus by a feed device, said apparatus comprising:

a base;

a roll adjacent the feed device and the path of movement of the product;

support means for supporting said roll for rotation relative thereto and for movement away from said path;

means for sensing movement of said roll away from said path;

a caliper member adjacent said support means;

means for mounting said support means on said base for movement relative to said base to a position in which said roll is spaced from said feed device a predetermined distance which is greater than the thickness of the product and less than the thickness of two products in response to positioning the product between said support means and said caliper member;

a spring biasing said support means relative to said base and toward said caliper member; and an adjustable member on said base and movable relative thereto to hold said support means against the spring bias in the position to which it is moved in response to positioning of the product between said support means and said caliper member.

7. An apparatus as defined in claim 6 wherein said support means comprises a linkage and said mounting means comprises a first shaft rotatably supported by said base for supporting said linkage for pivotal movement relative to said base, said linkage including a pair of arms extending angularly relative to each other and away from said shaft, said support means further including a second shaft supporting said roll for pivotal movement relative to one of the arms of said linkage, said caliper member being located adjacent the other arm of said linkage.

8. An apparatus as defined in claim 7 wherein said second shaft extends through said one arm and supports said roll at a location offset from the center of said roll.

9. An apparatus as defined in claim 8 wherein said roll is supported by a pair of discs fixed on said second shaft, said apparatus further including a bearing encircling said discs and supporting said roll for rotation relative to said discs.

10. Apparatus for sensing a double thickness of a sheet-like product being conveyed on a feed device, said apparatus comprising:

a roll adjacent the feed device;

a linkage having a pair of arms extending angularly relative to each other;

means for supporting said roll on one arm of said linkage for rotation relative thereto and for pivotal movement therewith;

a caliper member adjacent the other arm of said linkage;

means supporting said linkage for pivotal movement in response to the product being positioned between said caliper member and said other arm to position said roll away from said feed device a predetermined distance proportional to and exceeding the thickness of the product; and means for preventing said linkage from movement from the position to which it is pivoted by the product being positioned between said caliper member and said other arm to a position in which the distance between said roll and said feed device is less than said predetermined distance.

* * * * *